US006749164B2

(12) United States Patent
Wijnans

(10) Patent No.: US 6,749,164 B2
(45) Date of Patent: Jun. 15, 2004

(54) SECURING MEMBER FOR A SUPPORTING ARM MOVABLE WITHIN A VERTICAL GUIDE

(75) Inventor: Arthur Christiaan Wijnans, Soest (NL)

(73) Assignee: Fetim B.V., Amsterdam (NL)

( * ) Notice: Subject to any disclaimer, the term of this patent is extended or adjusted under 35 U.S.C. 154(b) by 0 days.

(21) Appl. No.: 10/093,530

(22) Filed: Mar. 11, 2002

(65) Prior Publication Data

US 2002/0166931 A1 Nov. 14, 2002

(30) Foreign Application Priority Data

May 8, 2001 (NL) ..... 1018019
Feb. 25, 2002 (EP) ..... 02075749

(51) Int. Cl.[7] ..... A47G 29/02
(52) U.S. Cl. ..... 248/244; 108/108; 248/250
(58) Field of Search ..... 248/235, 239, 248/244, 250, 220.31; 108/108

(56) References Cited

U.S. PATENT DOCUMENTS 4,094,415 A * 6/1978 Larson ..... 211/57.1
4,934,645 A * 6/1990 Breslow ..... 248/242
5,673,887 A * 10/1997 Hollingsworth et al. ..... 248/220.31
5,881,982 A * 3/1999 Hollingsworth et al. ..... 248/220.31
6,004,065 A * 12/1999 Higdon et al. ..... 403/384

FOREIGN PATENT DOCUMENTS

GB 2 082 893 A 3/1982
WO WO 92/09221 6/1992

* cited by examiner

*Primary Examiner*—Ramon O Ramirez
(74) *Attorney, Agent, or Firm*—Collier Shannon Scott, PLLC

(57) ABSTRACT

An assembly has a vertical guide including a base part provided with spaced-apart holes, raised edge portions and legs turned towards each other on the edge portions. The assembly also includes supporting arms that are movable within the vertical guide and securing members by which supporting arms can be secured within the vertical guide. The securing members can be placed in the holes with a stub and will come to bear against the inner side of the guide with their cams by rotation, in which a supporting arm will come to bear on the securing member through an obliquely extending contact surface.

26 Claims, 4 Drawing Sheets

SECURING MEMBER FOR A SUPPORTING ARM MOVABLE WITHIN A VERTICAL GUIDE

FIELD OF THE INVENTION

The present application relates to an assembly comprising a vertical guide, one or more supporting arms movable within the vertical guide and means by which a supporting arm can be secured in the vertical guide.

BACKGROUND OF THE INVENTION

UK-A-2 082 893 discloses a vertical guide in which a supporting arm having a dovetail guiding element fits. The dovetail element has a straight elongation extending into a recess in the supporting arm and car be pulled further into the supporting arm by a set screw. By this the arm is clamped, which, however does not give an actual guaranteed clamping.

PCT application WO 92/09221 discloses a supporting arm in which a small flexible plastic block is mounted which can be pulled back by a screw in such a way that an expanding portion of it will contact the vertical guide. With this solution too, there is no secure clamping. In these known systems, the supporting arms are continuously adjustable, which leads to the important disadvantage, that movement after clamping is not exactly unreal.

Further, there are the known systems in which supporting arms provided with hook members can be suspended into vertical profile elements, to which end spaced slots or keyhole-shaped holes for the hook members have been made in the profile elements. With this type of system, the position of a supporting arm, once it has been mounted at a certain height, will actually be guaranteed. A disadvantage of this type of system is the hardly attractive appearance, as a consequence of which they have been considered suitable for a limited number of applications only.

SUMMARY OF THE INVENTION

An object of the present invention is to provide for an assembly which does not have the above disadvantages, in which the supporting arms can take up guaranteed positions and in which the assembly has been arranged in such a way, that it can be used any where.

Accordingly, it is provided for that holes spaced at equal distances or otherwise have been made in the vertical guide and that the means, by which a supporting arm can be secured in the vertical guide, includes a securing member provided with a projecting stub, intended to be stuck into one of the holes in the vertical guide, and with locking or clamping means by which the securing member can be locked or clamped in the vertical guide. According to a further elaboration it has further been provided for, that the vertical guide comprises a base part having the spaced-apart holes therein, said base part being provided with raised edge portions and said edge portions being provided with legs facing each other.

The solution according to the invention provides for a separate securing member which realizes guaranteed positions of the supporting arms with the help of the holes in the base part of the vertical guide. Given the fact that the holes are situated within the vertical guide, which holes can be blind round holes of a relatively limited diameter, one will obtain a system in which the appearance will not be hindered by the known slots or keyhole-shaped holes of other systems.

Further, additional measures have been provided for actually being able to hold or clamp a securing member in place in a hole once it has been fitted there. Firstly, to that end the securing member comprises a body being mounted transversely to a longitudinal axis of the securing member, in which the projecting stub forms an extremity of the longitudinal axis, and in which the width of the body is narrower than the distance between the legs facing each other and the length of the body is larger than the distance between the raised edge portions. Preferably, the length, and in particular the length in a diagonal direction of the body, is larger than the distance between the raised edge portions.

Thus, one achieves that from the outside, the securing member can be mounted at any desired height in a hole in the base part of the vertical guide by the stub, and by rotating the securing member a quarter turn, in which the body with the longitudinal direction is brought from a vertical position to a horizontal position. Then the body will contact the raised edge portions and will have been locked in the vertical guide.

Preferably, it will further be provided for that the body is provided with cams situated diagonally opposite each other. The cams are intended for contacting the sides facing the base part of the legs projecting towards each other, on rotation of a securing member being stuck into a hole with the stub. In this way, the securing member can actually be fixedly received in the vertical guide. Instead of cams which will contact the bottom of the legs facing each other, cams which will contact the insides of the raised edge portion may also be provided.

Further, it is important how the supporting arm contacts the securing member. It is possible, for example, to have supporting arm and securing member contacting each other according to a horizontal contact surface, however, this is not preferred. According to a first further measure it is provided for, that at the side of the cams, the body is at least partly divided in two planes sloping in opposite directions and meeting along a central body axis which extends along a length direction of the body. Then, according to a second further measure it is provided for that a supporting arm has one extremity provided with at least one guiding element, intended to be received into a vertical guide, which extends up to both sides of the supporting arm, in which said guiding element is provided with a bevel at the side pointed downwards. In this structure, the supporting arm will come to near on a slanting surface of the body of the securing member with the beveled plane, which, definitely in case of a loaded supporting arm will provide the securing member from being rotated and also provides for a further clamping of the securing member. In this way, an additional security is obtained with these further measures.

Further, the lowermost part of the guiding element is forced towards the legs of the vertical guide facing each other, as a consequence of which tilting of the supporting arm around this point is impossible and an appropriate position of the supporting arm in relation to the vertical guide is guaranteed.

According to a further elaboration, a profile, e.g. a corrugation structure, can additionally be provided on at least one of the contact surfaces between securing member and supporting arm. Due to this, movement of a supporting arm in relation to a securing member can be completely prevented.

According to a further elaboration, it is further provided for that the guiding element has a recess in the middle, as a consequence of which said guiding element can fall partly around the axis of a securing member. Due to this, the maximum possible contact surface between supporting arm and securing member will be realized.

BRIEF DESCRIPTION OF THE DRAWINGS

The invention is further explained by way of the example given in the drawing on which.

DETAILED DESCRIPTION OF THE INVENTION

Figure 1:
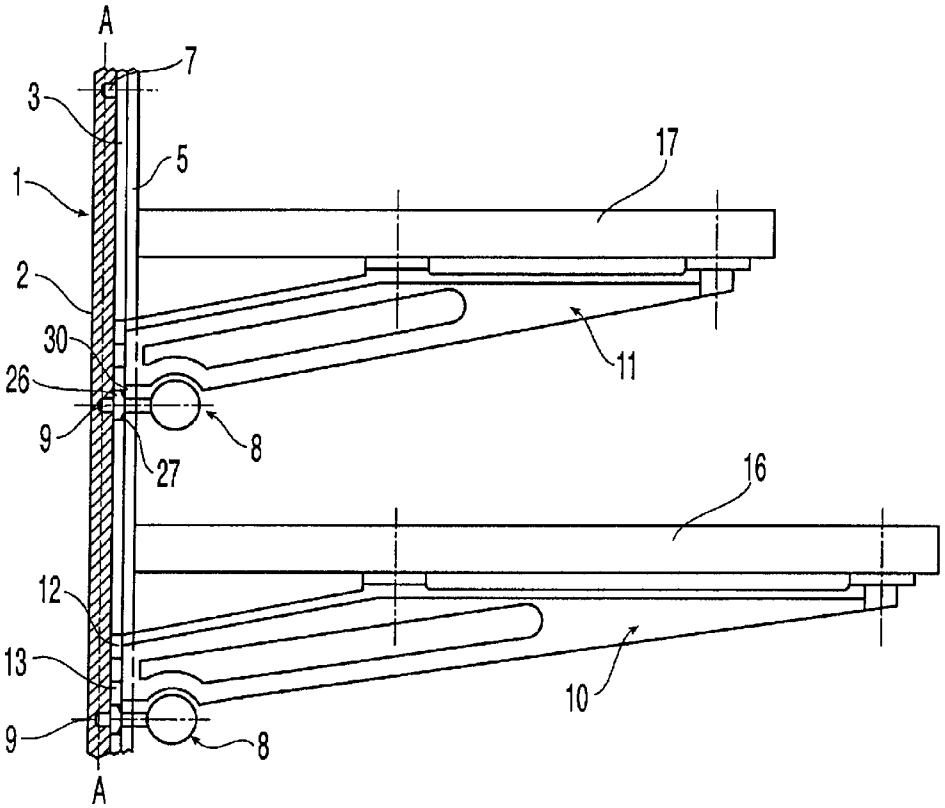
FIG. 1 shows, partly in cross-section and in view, a vertical guide having supporting arms and securing members.
Figure 2:
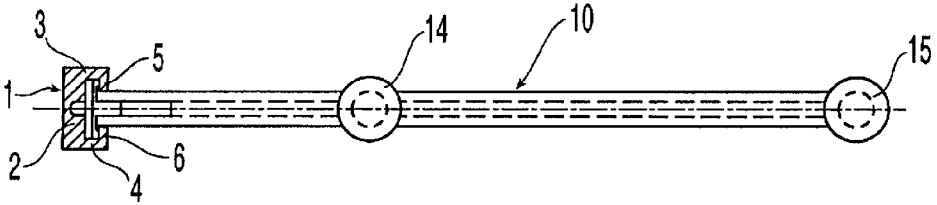
FIG. 2 shows a plan view of the assembly according to FIG. 1.

FIG. 1 shows a vertical guide 1 having a base part 2, raised edge portions 3, 4 and legs 5, 6 turned towards each other. A vertical guide axis A runs along the length of the vertical guide. The base part 2 contains spaced-apart blind holes 7 intended for receiving stubs 9 of securing members 8. Further, supporting arms 10, 11 of different lengths have been mounted, their extremities projecting into the vertical guide being provided with a first and a second guiding element 12, 13. In the example, the supporting arms are provided with pairs of bearing surfaces 14, 15, said bearing surfaces being provided with holes for fastening means. Shelves 16, 17 have been mounted on the bearing surfaces 14, 15.

Figure 3D:
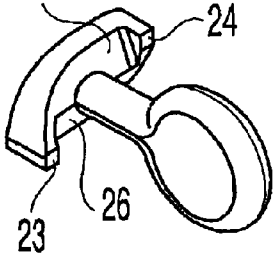
FIGS. 3A–E show some views of a securing member.
Figure 3E:
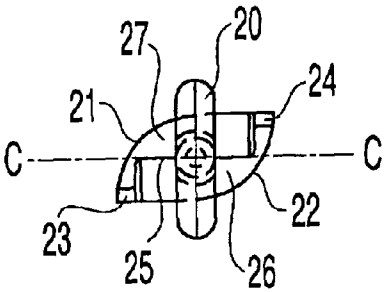
Figure 3B:
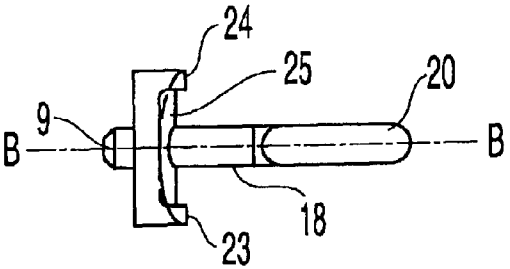
Figure 3A:
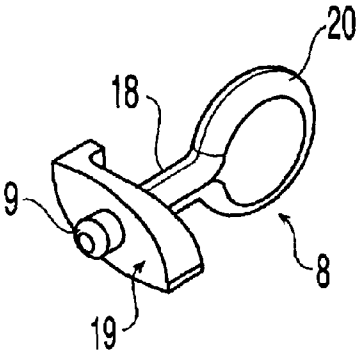
Figure 3C:
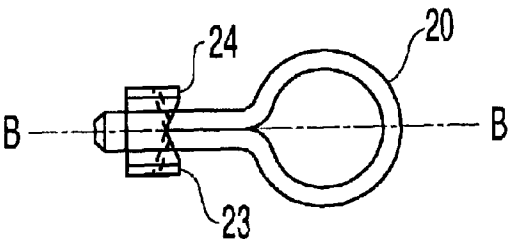

FIGS. 3A–E show a number of views of securing member 8 substantially comprising a pin 18 and a body 19 connecting to it, said pin 18 at one side ending in a stub 9 projecting from said body 19 and at the other side ending in a loop-shaped actuating member 20. As best seen in FIG. 3B, the body is mounted transversely to the longitudinal axis B of the securing member 8.

The body 19 is elongated in which the width of said body is smaller than the width of the opening between said legs 5, 6 turned towards each other of vertical guide 1. The length of said body 19 can be chosen to be smaller, equal to or larger than the distance between the raised sides of the vertical guide, in which preferably at least the length according to the diagonal is larger. In the embodiment illustrated, a smaller length according to the central body axis C extending along the body's length and a larger length according to the diagonal were chosen, as a result of which the body can be situated approximately square to the guide axis A of the vertical guide.

The contact surface of body 19, with which it will come to bear against the base part 2 of the vertical guide 1, is completely flat, just like the base part 2. In order to be able to turn said body 19 within the guide 1, two angle portions 21, 22 situated diagonally opposite one another are rounded off in such a way, that there the diagonal distance is smaller than the distance between the raised edge portions 3, 4.

In the example shown, cams 23, 24 are provided at the other corners, said cams are intended to bear against the inner sides of the legs 5, 6 turned to each other. However, it is equally possible to design the cams in such a way that they will come to bear against the raised edge portions 3, 4. The part of the top side of body 19 which is located between the cams 23, 24 is divided in two slanting surfaces 26, 27 along the central body axis C. Of said slanting surfaces 26, 27, always one surface will be the contact surface against which a guiding part 13 of a supporting arm 10, 11 will come to bear.

Figure 4A:
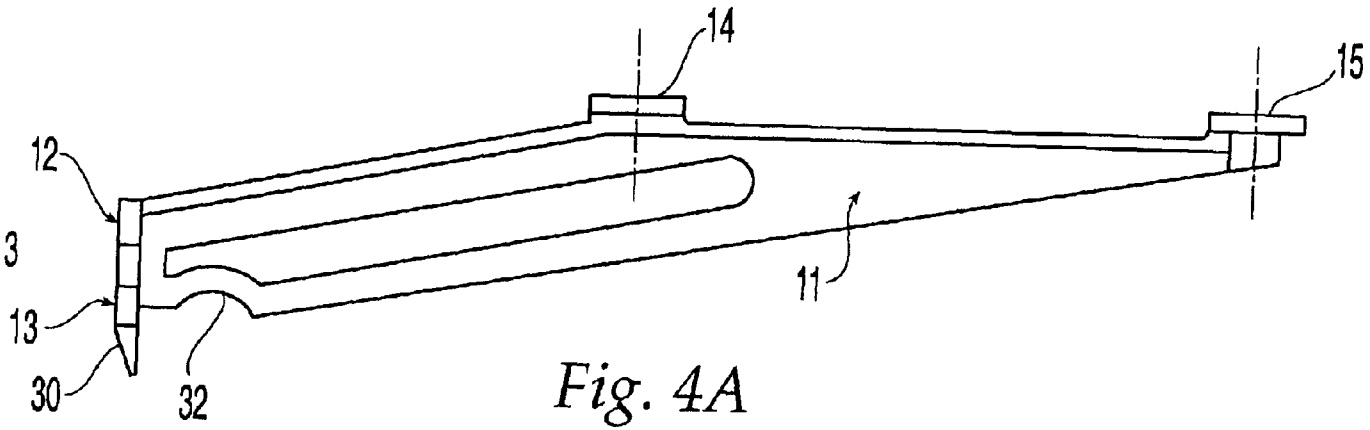
FIGS. 4A–C show some views of a supporting arm.
Figure 4B:
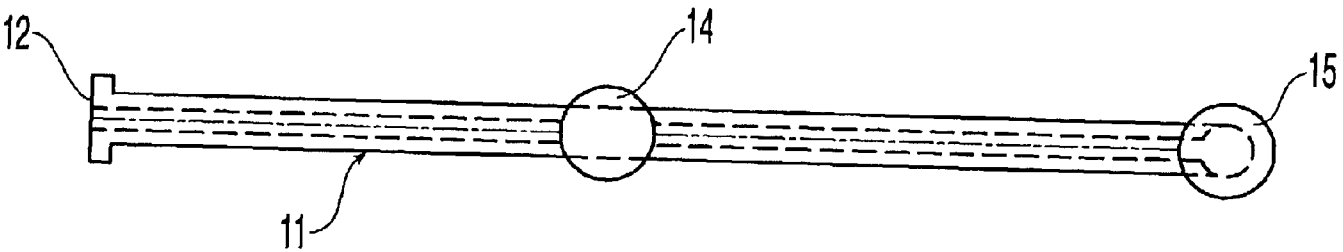
Figure 4C:
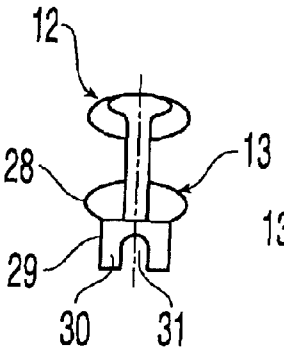

FIGS. 4A–C illustrate a number of views of a supporting arm 11 in which particularly the guiding elements 12, 13 at the extremity of the supporting arm 11 are important. It would also be possible to choose an integral guiding element instead of two separate guiding elements. The lowermost guiding element has parts 28, 29 of which part 28 has a width which is larger than the opening between the legs 5, 6 turned to each other and slightly smaller than the distance between raised edge portions 3, 4 of the vertical guide 1. Part 29 has a width which is smaller than the distance between the cams 23, 24 of the securing member 8 and also smaller than the opening between the legs 5, 6 turned to each other. Further, part 29 has a downwardly facing beveled surface 30 at the back, which is the surface of contact with one of the surfaces 26, 27 of the securing member 8. The bevel 30 and the surfaces 26, 27 can be provided with a corrugated structure as a result of which they can properly engage. This prevents supporting arm 10, 11 and securing member 8 from being easily movable in relation to one another, e.g., when the supporting arm is unintendedly hit from below. As seen in FIG. 4C, the bevel 30 is provided with a recess 31 which may allow the bevel to at least partially straddle the pin portion 18 of the securing member 8, when the assembly is in the clamped position.

In FIG. 1, the contact of surface 30 with one of the surfaces 26, 27 of said securing member is indicated diagrammatically. Owing to this, guides 12, 13 will come to rest against the legs 5, 6 turned to each other and owing to the locking of guide 13 between securing member 8 and legs 5, 6 turned to each other, tilting of a loaded supporting arm is excluded. Furthermore, the securing member is additionally held within a chosen hole 7.

Further, FIG. 4A indicates a recess 32 providing sufficient space for bringing actuating member 20 in the appropriate position.

Figures 5A, 5B:
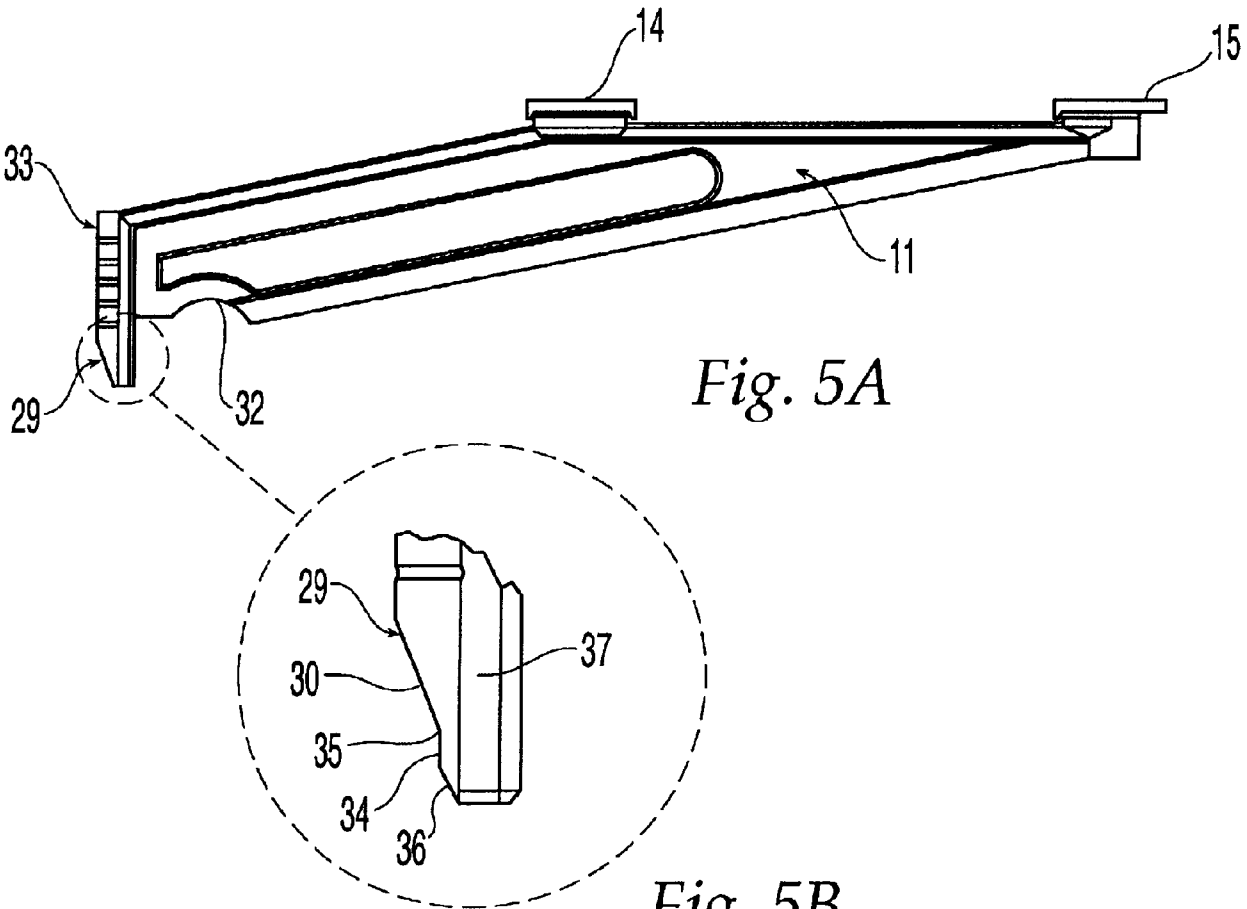
FIGS. 5A–B show a view of a further embodiment of a supporting arm and a detail thereof.

The example according to FIGS. 5A–B illustrates an embodiment in which the lowermost part 29 of the guiding element 33 has a downwardly facing bevel 30 connected, via a transition region 35, to a further straight part 34. There, the extremity is provided with a further bevel 36. Through this, it is achieved that when a supporting arm 12 is lowered onto a securing member 8, it will slide across a surface 26, 27 of said securing member 8 with the surface 36, and subsequently with straight part 34 across the center line 25, whereupon said supporting arm 11 will come to bear on a surface 26, 27 of said securing member with the beveled surface 30. Here, the transition region 35 ends approximately at the center line 25 of the body, which lies along the central body axis C.

This provides a proper locking between supporting arm 11 and securing member 8 as a result of which it is not easily possible to move said support arm in upward direction in relation of said securing member in case of, e.g., unintended exertion of a force onto the bottom of said supporting arm.

Finally, a rib 37 is provided on guiding element 33, which rib, in case of a supporting arm placed in a vertical guide 1, will come to rest between the legs 5, 6 turned towards each other and fittingly connected to them. This rib further contributes to a stable locking of a supporting arm 11 within a vertical guide 1, in which in particular lateral movement of the supporting arm is prevented.

What is claimed is:

1. A supporting assembly comprising:

a vertical guide having a guide axis and being provided with spaced apart holes along a length thereof;

at least one supporting arm movable within the vertical guide; and a securing member having a first end and second end, and configured to removably secure said at least one supporting arm in the vertical guide, the securing member comprising:

a longitudinal axis extending between the first end and the second end;

a projecting stub formed at the first end of the securing member, at least a portion of the projecting stub being configured and dimensioned to be removably inserted into one of said spaced apart holes; and a clamping member configured to clamp the securing member in the vertical guide, when the projecting stub is positioned in said one of said spaced apart holes;

wherein the second end of the securing member is provided with an actuating member;

wherein the supporting arm is provided with a recess for at least partly receiving the actuating member therein, when the supporting arm and the securing member are clamped in the vertical guide; and wherein the actuating member is aligned parallel to the guide axis, when the supporting arm and the securing member are clamped in the vertical guide.

2. A supporting assembly comprising:

a vertical guide having a guide axis and being provided with spaced apart holes along a length thereof;

at least one supporting arm movable within the vertical guide; and a securing member having a first end and second end, and configured to removably secure said at least one supporting arm in the vertical guide, the securing member comprising:

a longitudinal axis extending between the first end and the second end;

a projecting stub formed at the first end of the securing member, at least a portion of the projecting stub being configured and dimensioned to be removably inserted into one of said spaced apart holes; and a clamping member configured to clamp the securing member in the vertical guide, when the projecting stub is positioned in said one of said spaced apart holes;

wherein the vertical guide comprises:

a base part in which the spaced-apart holes are provided; and a pair of spaced apart raised edge portions extending from the base part, the raised edge portions each being provided with a leg, the legs of the raised edge portions facing each other.

3. The assembly according to claim 2, wherein the clamping member comprises:

a body having a central body axis and being mounted transversely to said longitudinal axis, a width of the body being narrower than a first distance between the legs facing each other and a length of the body along the central body axis being larger than a second distance between the raised edge portions.

4. The assembly according to claim 3, wherein a length along a first diagonal of the body is larger than the second distance between the raised edge portions of the vertical guide.

5. The assembly according to claim 3, wherein the body has a first pair of diagonally opposite corner portions each provided with a cam.

6. The assembly according to claim 5, wherein the cams are configured to contact the raised edge portions, upon rotation of the securing member when the projecting stub is positioned in one of said holes.

7. The assembly according to claim 5, wherein the cams are configured to contact sides of the legs, upon rotation of the securing member when the projecting stub is positioned in one of said holes.

8. The assembly according to claim 5, wherein the body has a second pair of diagonally opposite rounded corner portions which are distinct from the first pair of diagonally opposite corner portions.

9. The assembly according to claim 3, wherein the body is provided, on at least one side thereof, with at least one sloping surface.

10. The assembly according to claim 9, wherein the body is provided, on at least one side, with a pair of sloping surfaces which slope in opposite directions.

11. The assembly according to claim 9, wherein the supporting arm is provided with at least one guiding element receivable into said vertical guide, the at least one guiding element being provided with a downwardly facing beveled surface.

12. The assembly according to claim 11, wherein the downwardly facing beveled surface abuts said at least one sloping surface, when the securing member and the supporting arm are clamped in the vertical guide.

13. The assembly according to claim 12, wherein the downwardly facing beveled surface is provided with a recess whereby the downwardly facing beveled surface straddles a central pin of the securing member, when the securing member and the supporting arm are clamped in the vertical guide.

14. The assembly according to claim 12, wherein at least one of the downwardly facing beveled surface and the at least one sloping surface is corrugated.

15. The assembly according to claim 12, wherein the at least one guiding element further comprises a rib which, when the supporting arm is clamped in the vertical guide, is positioned between the legs of the vertical guide.

16. The assembly according to claim 11, wherein the downwardly facing beveled surface is connected, via a transition region, to a further part, the transition region being positioned approximately at the central body axis, when the supporting arm and the securing member are clamped in the vertical guide.

17. The assembly according to claim 11, wherein the second end of the securing member is provided with an actuating member.

18. The assembly according to claim 17, wherein the supporting arm is provided with a recess for at least partly receiving the actuating member therein, when the supporting arm and the securing member are clamped in the vertical guide.

19. The assembly according to claim 18, wherein the actuating member is aligned parallel to the guide axis, when the supporting arm and the securing member are clamped in the vertical guide.

20. The assembly according to claim 2, wherein the second end of the securing member is provided with an actuating member.

21. The assembly according to claim 20, wherein the supporting arm is provided with a recess for at least partly receiving the actuating member therein, when the supporting arm and the securing member are clamped in the vertical guide.

22. The assembly according to claim 21, wherein the actuating member is aligned parallel to the guide axis, when the supporting arm and the securing member are clamped in the vertical guide.

23. A supporting assembly comprising:

a vertical guide having a guide axis and being provided with spaced apart holes along a length thereof;

at least one supporting arm movable within the vertical guide; and a securing member having a first end and second end, and configured to removably secure said at least one supporting arm in the vertical guide, the securing member comprising:

a longitudinal axis extending between the first end and the second end;

a projecting stub formed at the first end of the securing member, at least a portion of the projecting stub being configured and dimensioned to be removably inserted into one of said spaced apart holes; and a clamping member configured to clamp the securing member in the vertical guide, when the projecting stub is positioned in said one of said spaced apart holes;

wherein:

the vertical guide comprises:

a base part in which the spaced-apart holes are provided; and a pair of spaced apart raised edge portions extending from the base part, the raised edge portions each being provided with a leg, the legs of the raised edge portions facing each other; and wherein the supporting arm is provided with at least one guiding element receivable into said vertical guide, the at least one guiding element being provided with a rib which, when the supporting arm is clamped in the vertical guide, is positioned between the legs of the vertical guide.

24. A supporting assembly comprising:

a vertical guide having a guide axis and being provided with spaced apart holes along a length thereof;

at least one supporting arm movable within the vertical guide; and a securing member having a first end and second end, and configured to removably secure said at least one supporting arm in the vertical guide, the securing member comprising:

a longitudinal axis extending between the first end and the second end;

a projecting stub formed at the first end of the securing member, at least a portion of the projecting stub being configured and dimensioned to be removably inserted into one of said spaced apart holes; and a clamping member configured to clamp the securing member in the vertical guide, when the projecting stub is positioned in said one of said spaced apart holes;

wherein the supporting arm and securing member are both provided with a corrugated structure.

25. A securing member having a first end and second end, the securing member comprising:

a longitudinal axis extending between the first end and the second end;

a projecting stub formed at the first end of the securing member;

an actuating member formed at the second end of the securing member; and a clamping member comprising a body mounted transversely to said longitudinal axis, the body having a thickness defined along said longitudinal axis, a width, and a length, and a central body axis extending along the length of the body, the body further comprising:

a first pair of diagonally opposite corner portions each provided with a cam;

a second pair of diagonally opposite rounded corner portions which are distinct from the first pair of diagonally opposite corner portions; and a pair of sloping surfaces provided on a first side of the body, the pair of sloping surfaces meeting at said central body axis and sloping in a direction of a second side of the body.

26. A supporting assembly comprising:

a vertical guide having a guide axis and being provided with spaced apart holes along a length thereof;

at least one supporting arm movable within the vertical guide; and a securing member having a first end and second end, the securing member comprising:

a longitudinal axis extending between the first end and the second end;

a projecting stub formed at the first end of the securing member;

an actuating member formed at the second end of the securing member; and a clamping member comprising a body mounted transversely to said longitudinal axis, the body having a thickness defined along said longitudinal axis, a width, and a length, and a central body axis extending along the length of the body, the body further comprising:

a first pair of diagonally opposite corner portions each provided with a cam;

a second pair of diagonally opposite rounded corner portions which are distinct from the first pair of diagonally opposite corner portions; and a pair of sloping surfaces provided on a first side of the body, the pair of sloping surfaces meeting at said central body axis and sloping in a direction of a second side of the body;

wherein the assembly is moveable between:

a disassembled condition in which the vertical guide, the at least one supporting arm and the clamping member are unconnected to one another; and an assembled condition in which the projecting stub is positioned in one of said spaced apart holes, a guiding element formed on the at least one supporting arm is positioned in the vertical guide, and the clamping member clamps said at least one supporting arm to the vertical guide.

* * * * *